US006901722B2

(12) United States Patent
Dextraze et al.

(10) Patent No.: US 6,901,722 B2
(45) Date of Patent: Jun. 7, 2005

(54) METHOD FOR PACKAGING MULTI-COMPONENT BEDDING ASSEMBLY

(75) Inventors: Paul N. Dextraze, Boothwyn, PA (US); Paul A. Haslanger, Swarthmore, PA (US)

(73) Assignee: Foamex L.P., Linwood, PA (US)

( * ) Notice: Subject to any disclaimer, the term of this patent is extended or adjusted under 35 U.S.C. 154(b) by 0 days.

(21) Appl. No.: 10/671,008

(22) Filed: Sep. 25, 2003

(65) Prior Publication Data

US 2005/0066624 A1 Mar. 31, 2005

(51) Int. Cl.[7] ..... B65B 31/04; B65B 63/02

(52) U.S. Cl. ..... 53/399; 53/434; 53/436; 53/445; 53/449; 53/512; 53/527; 53/582; 53/155; 53/173; 53/176; 206/223; 206/524.8

(58) Field of Search ..... 53/399, 432–434, 53/436, 438, 443, 445, 449, 469, 510–512, 53/523, 526, 527, 528, 154, 155, 173, 176, 53/284.7; 100/90; 206/223, 524.8

(56) References Cited

U.S. PATENT DOCUMENTS

| | | | | | |
|---|---|---|---|---|---|
| 3,238,599 | A | | 3/1966 | Bauman | |
| 3,246,443 | A | | 4/1966 | Slemmons | |
| 3,307,319 | A | * | 3/1967 | Christensen et al. | 53/434 |
| 3,458,966 | A | * | 8/1969 | Dunbar et al. | 53/430 |
| 3,521,424 | A | * | 7/1970 | Wirfel | 53/419 |
| 3,641,726 | A | | 2/1972 | Cassina | |
| 3,827,210 | A | * | 8/1974 | Smalley et al. | 53/434 |
| 3,935,690 | A | * | 2/1976 | Lea et al. | 53/397 |
| 3,968,620 | A | | 7/1976 | Keltner | |
| 4,108,063 | A | * | 8/1978 | Randolph | 100/352 |
| 4,418,514 | A | | 12/1983 | Spann | |
| 4,711,067 | A | | 12/1987 | Magni et al. | |
| 4,841,713 | A | * | 6/1989 | Beier | 53/413 |
| 4,928,337 | A | | 5/1990 | Chauncey | |
| 5,027,578 | A | * | 7/1991 | Natterer et al. | 53/86 |
| 5,097,648 | A | * | 3/1992 | Berner et al. | 53/88 |
| 5,622,030 | A | | 4/1997 | Steed et al. | |
| D395,780 | S | * | 7/1998 | Denney et al. | D6/596 |
| 5,832,701 | A | * | 11/1998 | Hauers et al. | 53/551 |
| 6,098,378 | A | | 8/2000 | Wyatt | |
| 6,739,107 | B1 | | 5/2004 | Lewis et al. | |
| 2003/0151295 | A1 | | 8/2003 | Nelson | |
| 2003/0183550 | A1 | * | 10/2003 | DiLiberto | 206/524.8 |

FOREIGN PATENT DOCUMENTS

| | | | | |
|---|---|---|---|---|
| JP | 03200515 | A * | 9/1991 | B65B 31/04 |

* cited by examiner

*Primary Examiner*—Stephen F. Gerrity
(74) *Attorney, Agent, or Firm*—Connolly Bove Lodge & Hutz LLP

(57) ABSTRACT

A multi-component bedding assembly, including a mattress or futon, is vacuum packaged in an air impermeable bag by drawing a vacuum at the open end of the bag and applying a ram or pushing force against the bedding assembly at the closed end of the bag. The pushing force may be intermittently cycled. The packaged bedding assembly also may be wrapped in a woven polyethylene overwrap and tied with bands before it is inserted into a shipping carton.

11 Claims, 2 Drawing Sheets

METHOD FOR PACKAGING MULTI-COMPONENT BEDDING ASSEMBLY

BACKGROUND OF THE INVENTION

The present invention relates to a packaging method for multi-component bedding, such as a mattress, mattress topper and one or more pillows. With such method, the multi-component bedding fits within a smaller, more convenient shipping container for transport and storage.

Sleep mattresses generally have a length of 75 to 80 inches, and width of between 39 to 80 inches, with a thickness varying from 6 to 16 inches. Such bulky size can make the mattress difficult to transport and store. Various methods for reducing the overall size of a mattress for transport are known.

U.S. Pat. No. 4,711,067 shows a method for individually packaging a mattress by compressing the mattress between platens to remove air from the mattress while holding the mattress in a flexible and sealable wrapper. The wrapper is sealed around the compressed mattress. The compressed, sealed mattress is then rolled into a tight coil and held in this coiled form by strings.

U.S. Pat. No. 6,098,378 similarly discloses a method for packaging a single mattress by compressing the mattress in a wrapper, rolling the compressed mattress and tying the rolled mattress with a string. The method further includes a piston to urge the rolled mattress into a packaging container.

U.S. Pat. No. 4,928,337 shows a method for compacting a futon or mattress. The mattress is folded into an S-shaped configuration and placed into an air-tight bag. A vacuum is applied to the open end of the bag to draw air out and compress the folded mattress to a more compact shape. When the mattress is removed from the bag it refills with air and recovers to its pre-compacted size and shape.

Each of the prior art packaging methods for mattresses was directed to packaging a single mattress or futon. Retailers have now begun to offer multi-component bedding assemblies which include a mattress, a mattress topper and one or more pillows together in a single package. While methods for vacuum compacting individual mattresses have been shown as described above, vacuum packaging a multi-component bedding assembly has not been shown. Vacuum packaging multi-components presents special difficulties not encountered when packaging a single mattress. For example, the irregular shape and different compaction characteristics of multiple different components make it difficult to draw air out of the bedding assembly evenly and consistently. In addition, different recovery forces of the various components may impose varying forces on the wrapping material and cording used to retain the vacuum-packaged assembly in its compacted form.

SUMMARY OF THE INVENTION

A first aspect of the invention is a method for packaging a multi-component bedding assembly. First, a plurality of bedding components are wrapped in a bag having an open first end and a second end. The bedding components include a mattress or futon and one other bedding component, such as one or more pillows, a topper, a duvet or bed covering, etc. The second end of the bag may be closed or open. After the bedding components are wrapped in the bag, a vacuum is drawn at the first end of the bag to remove a portion of air from the bag. Preferably the vacuum is drawn at a pressure of from 20 to 30 in Hg. While the vacuum is being drawn, the bedding components concurrently are pushed toward the first end of the bag by applying a force at the second end of the bag. The pushing or ramming force may be applied intermittently (e.g., cycled). The pushing or ramming force may be applied by a ram at a force of from 1 to 1000 lbs. Once the bedding components are reduced to a desired volume size for packaging, the vacuum source is removed and the bag is sealed to form the packaged bedding assembly.

Preferably, the method further includes wrapping one or more bands around the bag after the open first end has been sealed, and inserting the packaged bedding assembly into a woven polyethylene supporting sleeve. Most preferably, one or more bands are wrapped around the woven sleeve. The packaged bedding assembly held within the woven polyethylene sleeve may then be placed into a shipping carton for transport and storage. The woven sleeve may be marked with a cutting zone to assist the purchaser when the packaged bedding assembly is to be opened from its compressed packaging.

DESCRIPTION OF THE PREFERRED EMBODIMENTS

Figure 1:
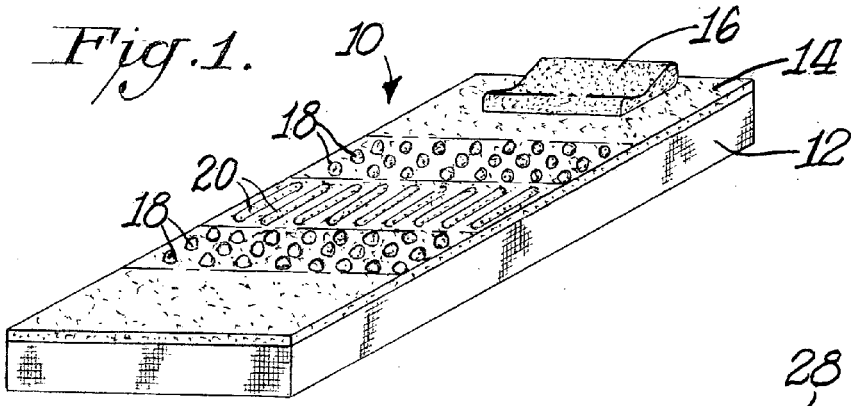
FIG. 1 is a perspective view of a twin-sized foam bedding mattress, a contour-cut mattress topper and a contoured pillow forming a multi-component bedding assembly.

Referring first to FIG. 1, a bedding assembly 10 comprises a foam mattress 12, a mattress topper 14 and a pillow 16. The foam mattress preferably is constructed of polyurethane foam and may be encased in ticking fabric. The mattress may also comprise a futon or other sleeping surface, and may be formed of another compressible material, or combination of foam and such other compressible material. Mattresses that are twin-sized, twin-extra large-sized, full-sized, queen-sized, king-sized and California king-sized may be packaged in a bedding assembly according to the method of the invention. A twin-sized mattress is shown in FIG. 1.

The mattress topper 14 is shown as having a five-zone contoured top surface with convolute cut projections of varying depth and dimension to provide varying support characteristics. The peaks 18 of "egg crate" convolute are shown schematically in two of the zones. The ridges 20 of other cut projections are shown schematically in one of the zones. Any variation in convolute cut or otherwise shaped projections may be provided on the topper surface for optimum comfort and body support. The shaped projections 18, 20 may be formed by means other than convolute cutting. The top surface alternatively may be flat, with no contouring, or may have fewer or more than five zones. The mattress topper 14 is an optional component of the bedding assembly 10.

The pillow 16 is shown as a contoured shaped foam pillow with two lobes defining a head supporting trough therebetween. The pillow preferably is encased in a ticking fabric. Optionally, two or more pillows may be provided as part of the bedding assembly 10. Such pillows may be of the same size, shape and configuration, or may be different. Alternatively, the pillow may be a compressible pillow made of material other than foam, such as a pillow filled with fiber fill or down. The pillow 16 is an optional component of the bedding assembly 10.

Other components of the bedding assembly 10 may optionally comprise a bed covering, a blanket, a duvet, a comforter, or any other customary component of a bedding assembly.

Figure 2:
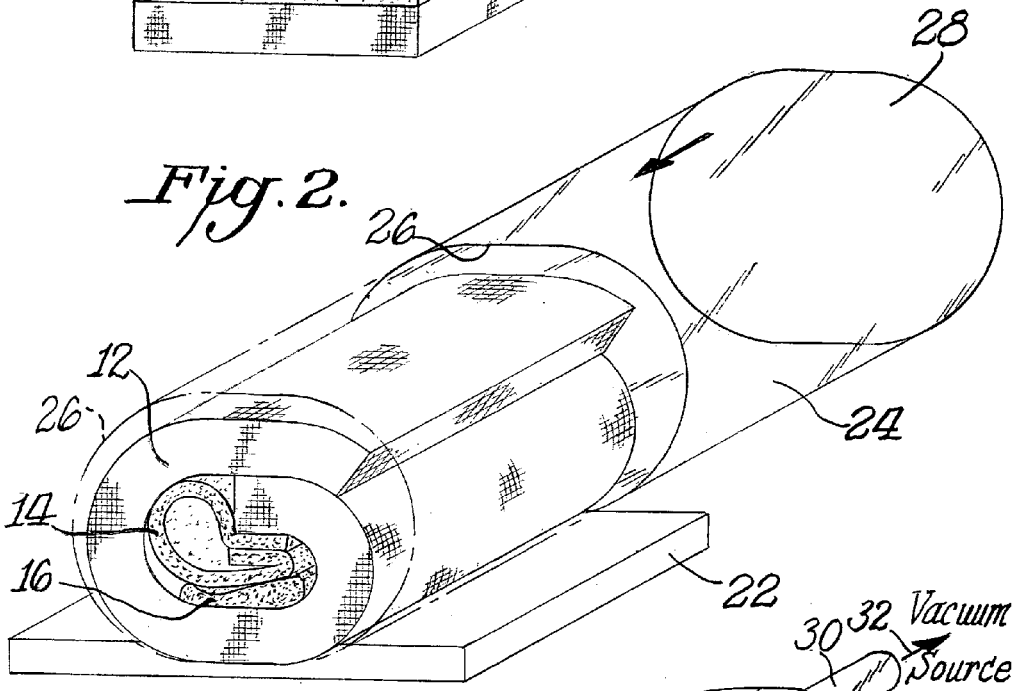
FIG. 2 is a perspective view illustrating a first step of a packaging method of the invention in which an air impermeable bag is placed over a folded bedding assembly.

One embodiment of the packaging method according to the invention is shown in FIGS. 2 to 9. Referring first to FIG. 2, the bedding assembly 10 is folded by thirds into a C-fold and placed onto a support plate 22. The folded bedding assembly defines an original volume. A sleeve or bag 24 has an open end 26 and a closed end 28. Alternatively, the sleeve 24 may have two open ends. The folded bedding assembly is inserted axially into the sleeve or bag 24.

Preferably the sleeve or bag 24 is formed from a blend of linear low density polyethylene that has high slip and is anti-block treated, available from AEP Industries, Inc. of South Hackensack, N.J. Such preferred bag has a gauge of about 0.0025 inch, material density from about 0.921 to 0.925 g/cm$^3$, a tensile strength of about 3000 psi (ASTM D822), elongation of about 350 to 700% (ASTM D822), and tear strength from 250 to 600 g (ASTM D1922). Preferably, the bag is clear in color, but colored polyethylene material may also be used. When packaging a twin sized mattress, the bag has a width of about 50 inches and a length of about 70 to 75 inches. The length is increased when packaging larger sized mattresses, up to preferably about 125 inches for a king sized mattress.

Figure 3:
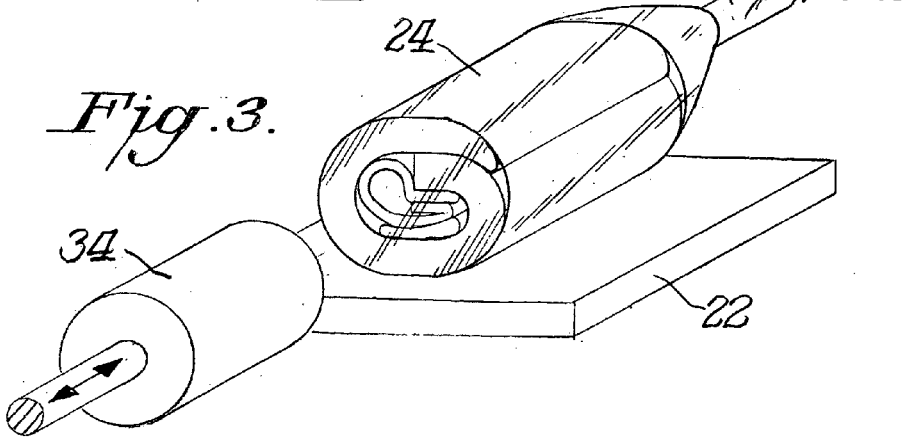
FIG. 3 is a perspective view illustrating a second step of the packaging method in which a vacuum is drawn at one end of the bag while a ram urges the bedding assembly towards the vacuum source.
Figure 4:
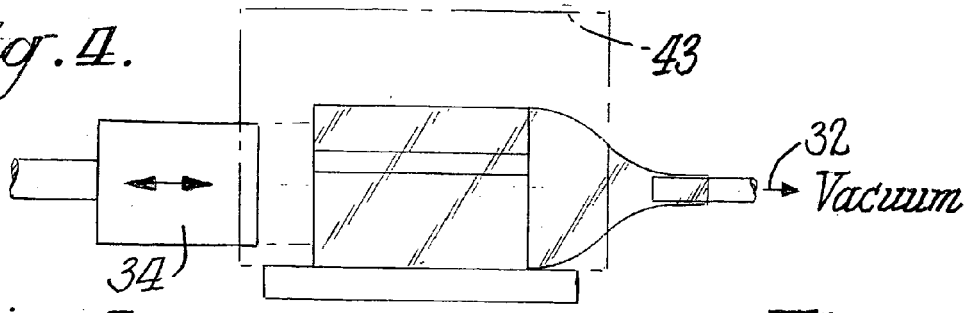
FIG. 4 is a side elevational view of FIG. 3 showing the bedding assembly within the bag as vacuum is drawn and ram force is applied, wherein the bag and bedding assembly prior to vacuum compression is shown in phantom outline.

Referring next to FIGS. 3 and 4, a tube or hose 30 that connects to a vacuum source 32 is attached to the open end 26 of the bag 24. As a vacuum is drawn to remove air from the inner portion of the bag and from the voids in the foam structure of the foam mattress 12 and other compressible components of the bedding assembly, a ram 34 is urged against the closed end 28 and directs an axial force against the bedding assembly toward the open end 26. Preferably, the ram exerts a force in the range of 1 to 1000 lbs., more preferably 100 to 400 lbs., to urge and compress the bedding assembly in the axial direction as the vacuum is drawn. Optionally, the ramming force may be cycled or applied intermittently. The vacuum is applied preferably at a pressure of 20 to 30 in. Hg., most preferably 28.5 in. Hg.

The vacuum is drawn and ramming force applied until the bedding assembly is reduced in volume by 50%, preferably by 60% and most preferably by 80% of its original volume. In FIG. 4, the original volume of the bedding assembly 10 within the bag 24 is shown in phantom outline 43.

Figure 5:
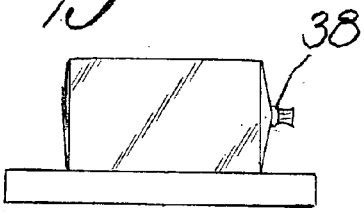
FIG. 5 is a side elevational view of the compressed and packaged bedding assembly wherein one bag end is wrapped with a band and the other bag end is folded and taped after the vacuum source is removed.
Figure 6:
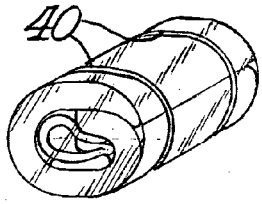
FIG. 6 is a perspective view of the compressed and packaged bedding assembly of FIG. 5 wherein the central portion is banded around the circumference with one or more bands.

Referring next to FIG. 5, the vacuum hose is removed and the open end 26 is sealed, preferably with a band 38. If a sleeve with two open ends is used, the ends of the sleeve may be folded and sealed with tape. Alternate sealing methods may be used, such as adhesive or heat bonding. Preferably, the band 38 is removed by cutting, and the excess bag material is cut away, then the remaining portion is folded and sealed with tape. In addition, as shown in FIG. 6, bands 40 are wrapped around the compacted bedding assembly to form the packaged bedding assembly. The bands 40 may be wrapped either circumferentially, as shown in FIG. 6, or generally axially.

The packaged bedding assembly should be stable enough to remain compacted over a substantial time, preferably longer than the expected storage and transport time for the bedding assembly. Commonly, bedding assemblies remain packaged for one week up to six months.

Figure 7:
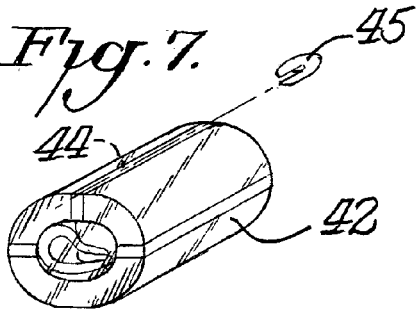
FIG. 7 is a perspective view of the packaged bedding assembly, wrapped in a woven polyethylene sleeve.
Figure 8:
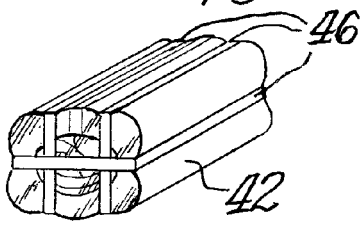
FIG. 8 is a perspective view of the packaged bedding assembly, wherein bands are provided generally axially around the packaged bedding assembly and the woven polyethylene sleeve.

To ensure storage and transport stability over a substantial duration and over varying temperature and pressure conditions, it is preferred to wrap the packaged bedding assembly in an overwrap or sleeve. As shown in FIG. 7, a woven polyethylene sleeve 42 is wrapped around the packaged bedding assembly. Preferably, the axial ends of the woven sleeve 42 are sealed with tape, although other sealing means may be used. Preferably, the woven sleeve 42 is provided with a cut line 44 that is a predetermined line of weakness to permit a customer to more readily locate the optimum line to cut through the woven sleeve 42 to release the packaged bedding assembly. In addition, as shown in FIG. 8, bands 46 are tied around the sleeve 42 and packaged bedding assembly. Bands 46 are shown wrapped generally axially in FIG. 8, but one or more of such bands may also be wrapped generally circumferentially around the sleeve and packaged bedding assembly.

In the preferred embodiment, the woven sleeve 42 is formed from a continuous length woven polyethylene sleeve available from Fabrene Industrial Fibers of North Bay, Ontario, Canada. The sleeve is formed by weaving high density polyethylene tapes having a denier from about 770 g/9 kg in the warp direction, and about 1005 g/9 kg in the weft direction. The woven tapes are coated with a high density polyethylene to a coating thickness of about 0.9 mil. For the weave, the tapes per inch in the warp direction are preferably about 9 to 10 and the tapes per inch in the weft direction are preferably about 8 to 9. The woven sleeve material has a weight of 2.7 ounces per yard. The sleeve is formed into the shape of a tube having a diameter of about 15 inches for a twin size mattress and about 16 inches for larger mattresses.

In the preferred embodiment, the bands 40, 46 are polyethylene bands with high tear strength.

Figure 9:
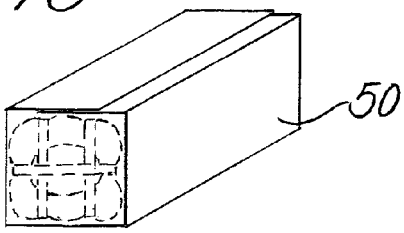
FIG. 9 is a perspective view of the packaged bedding assembly within a shipping carton.

The packaged bedding assembly as shown in FIG. 8 is ready for packaging into a shipping carton 50 as shown in FIG. 9. Shipping carton 50 contains a packaged bedding assembly therein shown in phantom outline. The carton may be sealed by adhesive or by tape as known (not shown).

The bedding assembly may be released from the packaging by breaking bands 46 and cutting the woven sleeve 42 with blade 45 as shown in FIG. 7. With the sleeve 42 removed, the bag 24 and bands 40 then may be sliced to release the packaged bedding assembly. As air reenters into the compressible structures of the bedding components in the bedding assembly, the foam mattress and other bedding components recover to their original volume and size. Preferably, the mattress recovers to its original volume and size at a slower rate (e.g., in 5 to 20 minutes).

We claim:

1. A method for packaging a multi-component bedding assembly, comprising:

wrapping a plurality of bedding components including a mattress or futon in a bag having an open first end and a second end;

drawing a vacuum at the first end of the bag to remove a portion of air from the bag;

pushing the bedding components toward the first end of the bag by applying a force at the second end of the bag, and sealing the open first end to form a packaged bedding assembly.

2. The method of claim 1, wherein the pushing force is applied intermittently.

3. The method of claim 2, wherein the pushing force is applied by a ram at a force of 1 to 1000 lbs.

4. The method of claim 1, wherein the vacuum is drawn at a pressure of from 20 to 30 in. Hg.

5. The method of claim 1, wherein the second end of the bag is closed.

6. The method of claim 1, further comprising wrapping one or more bands around the bag after the open first end has been sealed.

7. The method of claim 1, further comprising inserting the packaged bedding assembly into a woven polyethylene supporting sleeve.

8. The method of claim 7, further comprising marking a cutting zone on the woven sleeve.

9. The method of claim 7, further comprising applying one or more bands around the woven sleeve.

10. The method of claim 9, further comprising inserting the packaged bedding assembly wrapped with the woven polyethylene sleeve into a shipping carton.

11. The method of claim 1, wherein the bedding components comprise a foam mattress, a mattress topper and a pillow.

* * * * *